US009480385B2

(12) United States Patent
Askin et al.

(10) Patent No.: US 9,480,385 B2
(45) Date of Patent: Nov. 1, 2016

(54) DISHWASHER

(75) Inventors: Ufuk Askin, Istanbul (TR); Songul Bayraktar, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1804 days.

(21) Appl. No.: 12/675,786

(22) PCT Filed: Aug. 27, 2008

(86) PCT No.: PCT/EP2008/061182

§ 371 (c)(1),
(2), (4) Date: May 13, 2011

(87) PCT Pub. No.: WO2009/027415

PCT Pub. Date: Mar. 5, 2009

(65) Prior Publication Data

US 2011/0240071 A1 Oct. 6, 2011

(30) Foreign Application Priority Data

Aug. 31, 2007 (TR) ..... a 2007 06040

(51) Int. Cl.

| | |
|---|---|
| ***A47L 15/42*** | (2006.01) |
| ***A47L 15/23*** | (2006.01) |
| ***A47L 15/50*** | (2006.01) |

(52) U.S. Cl.

CPC ..... *A47L 15/23* (2013.01); *A47L 15/508* (2013.01)

(58) Field of Classification Search

CPC ..... A47L 15/508; A47L 15/23
USPC ..... 134/56 D, 57 D, 58 D, 198
See application file for complete search history.

(56) References Cited

U.S. PATENT DOCUMENTS

| | | | | |
|---|---|---|---|---|
| 2,013,387 | A | 9/1935 | Johnston | |
| 2,154,559 | A * | 4/1939 | Bilde | 134/97.1 |
| 2,808,842 | A * | 10/1957 | Pollock et al. | 134/103.1 |
| 3,020,917 | A * | 2/1962 | Lyman | 134/58 D |
| 3,810,480 | A * | 5/1974 | Smith et al. | 134/104.1 |
| 5,413,130 | A * | 5/1995 | Maruyama et al. | 134/95.3 |
| 5,464,482 | A * | 11/1995 | Michael et al. | 134/25.2 |
| 5,725,002 | A * | 3/1998 | Payzant | 134/95.3 |
| 6,869,029 | B2 * | 3/2005 | Ochoa et al. | 239/380 |
| 2005/0133070 | A1 * | 6/2005 | Vanderroest et al. | 134/56 D |
| 2006/0237050 | A1 * | 10/2006 | Weaver et al. | 134/56 D |
| 2007/0006903 | A1 | 1/2007 | Koch et al. | |

FOREIGN PATENT DOCUMENTS

| | | | |
|---|---|---|---|
| JP | 2001299665 | A | 10/2001 |
| JP | 2003232068 | A | 8/2003 |

* cited by examiner

*Primary Examiner* — Michael Barr
*Assistant Examiner* — Benjamin L Osterhout
(74) *Attorney, Agent, or Firm* — Kilpatrick Townsend & Stockton LLP

(57) ABSTRACT

The present invention relates to a dishwasher (1) comprising at least one distributor (6) that enables water transfer to the spray arm (4) and at least one auxiliary nozzle (7) positioned over the distributor (6) between the basket (3) and the main nozzles (5).

8 Claims, 2 Drawing Sheets

DISHWASHER

Figure 1:
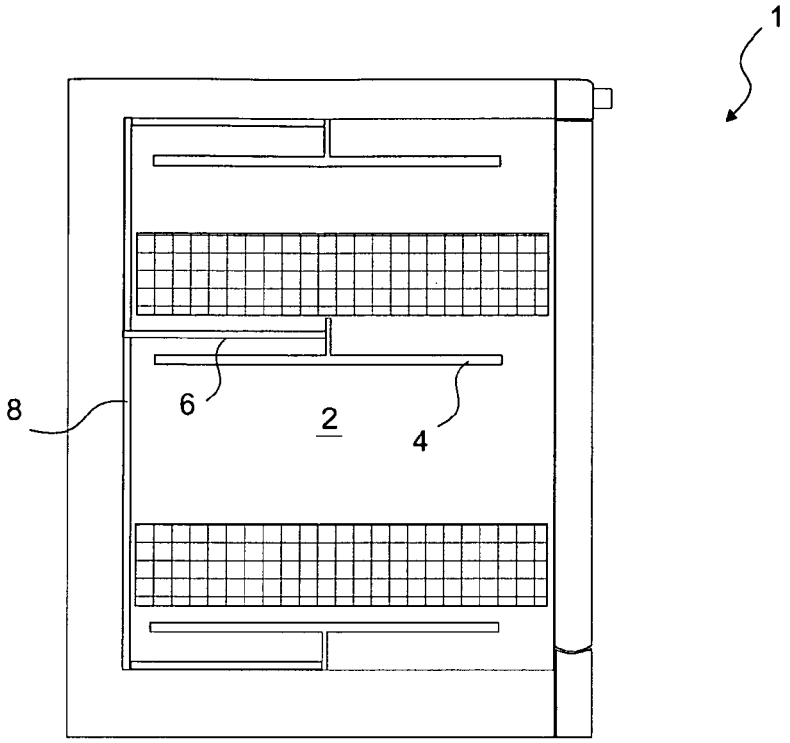

The present invention relates to a dishwasher that accomplishes an efficient washing operation.

In dishwashers, cleaning the objects loaded inside a basket is achieved by means of spray arms arranged below the said basket by spraying water over these objects, in particular through spray arms which are provided underneath a top basket and to which a pipe supplies water. However, dead zones occur at the distributor level because water colliding with the pipes cannot gain access to the basket above, and therefore objects loaded in those zones cannot be thoroughly cleaned.

Various embodiments wherein the distributor is adjusted in different manners are developed in the technique to overcome these problems and to achieve a more efficient washing.

In the state of the art Japanese Patent Application No JP2001299665, a distributor conveyed upwards from the bottom of the washing tank is connected to a mechanism provided with upward-facing double spray arms. Washing is accomplished by way of water sprayed from the spray arms onto the basket arranged above. In this embodiment, in order to ensure an efficient wash of the area between the two spray arms, a nozzle is provided over the connecting pipe arranged at a point that falls in the middle of the said two spray arms, said nozzle spraying thus water from this point, too.

However, in these embodiments known in the technique, while efficient wash through the adjustment of a distributor is achieved, the volume for loading objects is reduced or the supply pipes are arranged in a way that will necessarily handicap the user while loading.

The aim of the present invention is the realization of a dishwasher wherein washing efficiency is increased without causing loss in volume for loading objects to be washed inside a washing tank.

The dishwasher which is realized in order to attain the aim of the present invention, explicated in the first claim and the respective claims thereof, comprises a spray arm that provides to spray water upwards onto the objects loaded inside a basket, at least one main nozzle arranged over the said spray arm permitting water exit there from, and at the minimum one distributor that conveys water to the spray arm and arranged so as to be at least partly located between the basket and the spray arm.

The distributor comprises at least one auxiliary nozzle provided over the surface that faces the basket. Water spray from the spray arm obstructed by the distributor can thus be spread onto the dead zones, ensuring an efficient cleaning in these zones, too.

In an embodiment of the invention, the distributor comprises an intermediary element attached to the feeder conduit, an adaptor over which the spray arm is fastened and which is mounted onto the basket, and a pipe which joins the intermediary element to the adaptor and which maintains water transfer from the feeder conduit to the spray arm. Auxiliary nozzles are arranged over the pipe.

In an embodiment of the invention, in order to minimize pressure drop of water conveyed to the spray arm, occasioned by auxiliary nozzles, the said nozzles are arranged over the side of the pipe near the adaptor. Pressurized water is thus conveyed to the spray arm, ensuring an efficient wash.

In the preferred embodiment of the present invention, auxiliary nozzles arranged over the side of the pipe near the adaptor spray water towards the side near the intermediary element where there are fewer auxiliary nozzles, ensuring efficient wash in these zones, too.

In another embodiment of the invention, the adaptor is provided with at least one auxiliary nozzle.

In an embodiment of the invention, auxiliary nozzles are configured as rotary nozzles. Water is projected in rotations from the said nozzles and produces a hard blow effect on the surfaces hit, ensuring therefore the removal of dirt easily In another embodiment of the invention, at least one of the auxiliary nozzles is provided with a shower cap. This causes water to be spread over a greater area and ensures efficient cleaning.

By means of the present invention, a more efficient washing is enabled by way of supplying water spray from the main nozzles arranged over the spray arm onto the dead zones inaccessible because of the distributor's obstruction.

A dishwasher realized in order to attain the aim of the present invention is illustrated in the attached figures, where:

FIG. 1—is the schematic side view of a dishwasher.

Figure 2:
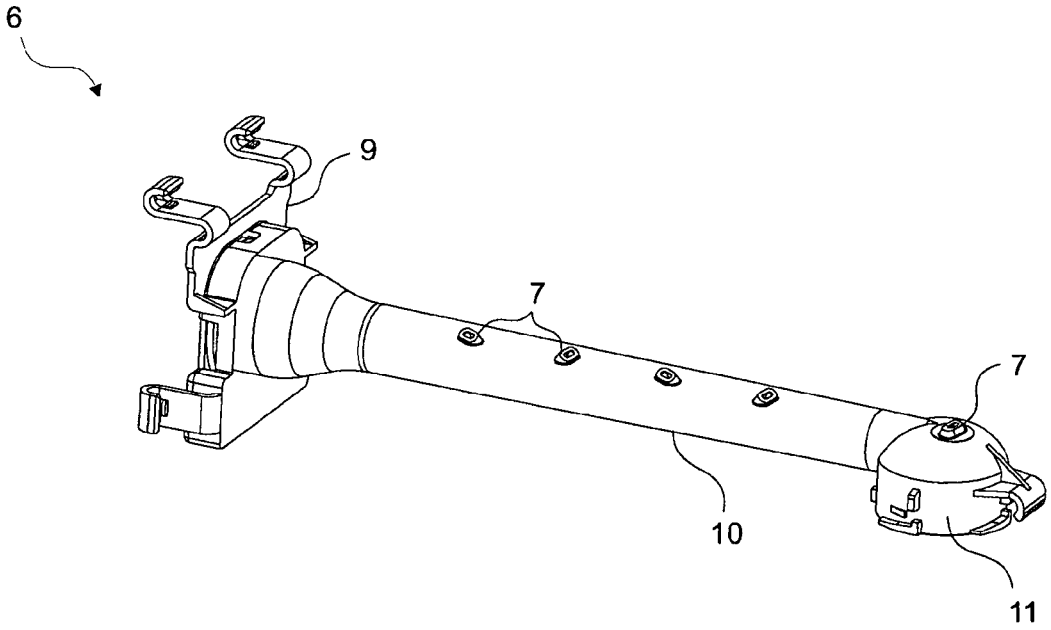

FIG. 2—is the perspective view of a distributor.

Figure 3:
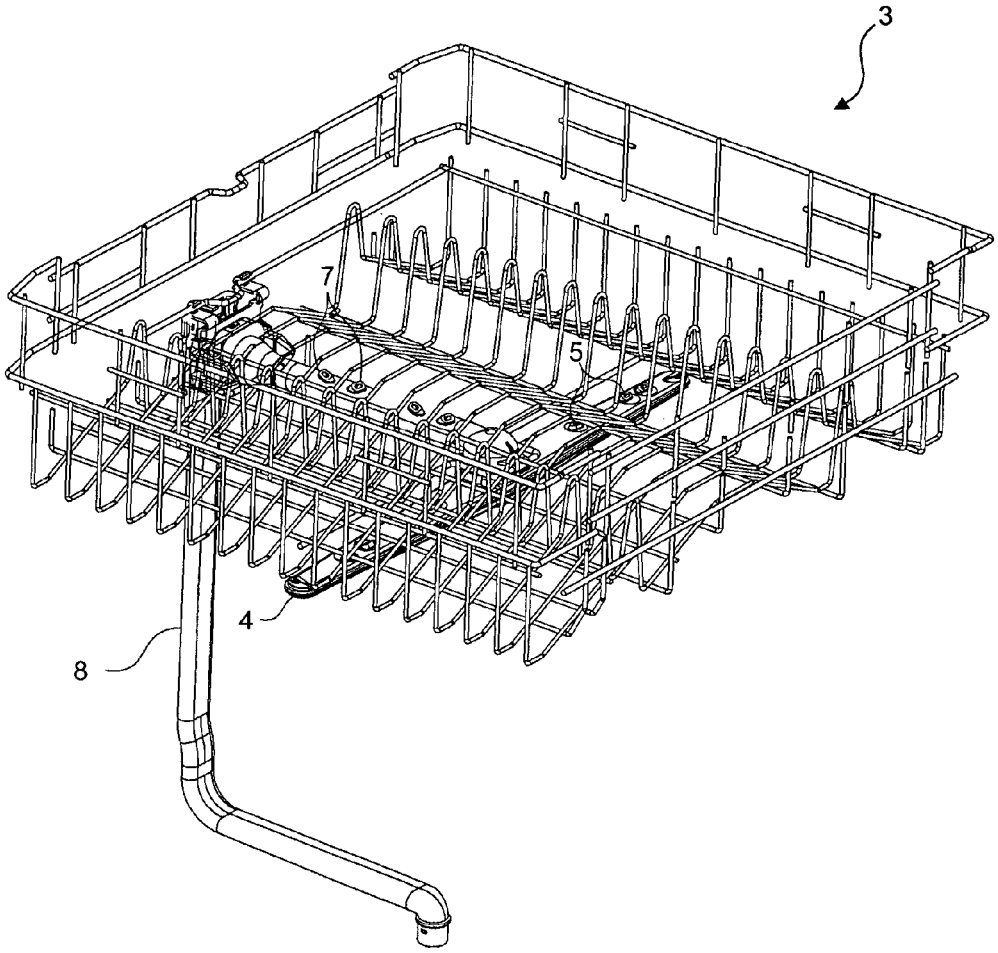

FIG. 3—is the perspective view of a distributor arranged below a basket.

The elements illustrated in the figures are numbered as follows:

1. Dishwasher
2. Washing tank
3. Basket
4. Spray arm
5. Main nozzle
6. Distributor
7. Auxiliary nozzle
8. Feeder conduit
9. Intermediary element
10. Pipe
11. Adaptor The dishwasher (1) of the present invention comprises a washing tank (2), at least one basket (3) arranged inside the washing tank (2) enabling an orderly positioning of objects inside the said washing tank (2), a feeder conduit (8) that conveys wash water provided from the distribution network towards the required areas inside the washing tank (2), at least one spray arm (4) which enables water spray onto the objects placed inside the basket (3), at least one main nozzle (5) arranged over the spray arm (4) to provide water spread from the spray arm (4), and a distributor (6) connected to the feeder conduit (8) by one end and to the spray arm (4) by the other end, transferring water from the feeder conduit (8) to the spray arm (4), positioned so as to be at least partly located between the spray arm (4) and the basket (3) (FIG. 1).

The said dishwasher (1) also comprises at least one auxiliary nozzle (7) arranged on the surface of the distributor (6) facing the basket (3) (FIG. 2). Auxiliary nozzles (7) provide a more efficient wash by enabling water spread onto the objects otherwise inaccessible because of the distributor (6) located between the spray arm (4) and the basket (3) obstructing water spray from the spray arm (4).

One embodiment of the present invention, there exist several auxiliary nozzles (7) arranged at intervals all along the distributor (6). This enables more abundant water access to the dead zones.

In an embodiment of the present invention, the distributor (6) comprises an intermediary element (9) attached to a feeder conduit (8), an adaptor (11) over which a spray arm (4) is fastened and which is provided above the basket (3), and a pipe (10) which joins an intermediary element (9) to an adaptor (11), enabling water transfer from the feeder conduit (8) to the spray arm (4).

In an embodiment of the present invention, auxiliary nozzles (7) are arranged over the pipe (10) near the adaptor (11). This way, drop in water pressure conveyed to the spray arm (4) by the auxiliary nozzles (7), is kept at minimum.

In the preferred embodiment of the present invention, at least one of the auxiliary nozzles (7) arranged over the side of the pipe (10) near the adaptor (11) is configured so as to be able to spray water towards the intermediary element (9).

In one other embodiment of the present invention, the adaptor (11) is provided with at least one auxiliary nozzle (7).

In one other embodiment of the present invention, the auxiliary nozzles (7) are configured as rotary nozzles. In this embodiment, water is sprayed from the rotating auxiliary nozzles (7) and produces a hard blow effect on the objects to be washed, improving therefore cleaning efficiency.

In another embodiment of the present invention, the dishwasher (1) comprises a shower cap provided on top of at least one auxiliary nozzle (7). This enables water to be sprayed over a greater area and keeps the number of zones inaccessible for water spread at minimum.

In the dishwasher (1) of the present invention, cleaning efficiency is improved by way of auxiliary nozzles (7) provided over the distributor (6) which augment water access from the main nozzles (5) arranged over the spray arm (4) towards certain parts of the basket (3) otherwise obstructed by the said distributor (6).

The invention claimed is:

1. A dishwasher (1) comprising a washing tank (2), at least one basket (3) arranged inside the said washing tank (2), a feeder conduit (8) which enables the transfer of wash water to areas inside the washing tank (2), at least one spray arm (4) which enables water spray onto the objects placed inside the at least one basket (3), at least one main nozzle (5) which is arranged over the at least one spray arm (4) and which enables water spread from the spray arm (4), and a distributor (6) having a surface and connected to the feeder conduit (8) by one end and to the at least one spray arm (4) by the other end and having at least one auxiliary nozzle (7) between the one end and the other end and the at least one auxiliary nozzle arranged on the surface facing the basket (3), transferring water from the feeder conduit (8) to the spray arm (4) and positioned so as to be at least partly located between the spray arm (4) and the basket (3).

2. The dishwasher (1) as in claim 1, wherein the distributor (6) comprises an intermediary element (9) attached to the outlet of the feeder conduit (8), an adaptor (11) arranged over the basket (3) and onto which a spray arm (4) is fastened, and a pipe (10) which, joining the intermediary element (9) and the adaptor (11,) enables water transfer from the feeder conduit (8) to the spray arm (4).

3. The dishwasher (1) as in claim 2, wherein the at least one auxiliary nozzle (7) arranged over on the pipe (10) near the adaptor (11).

4. The dishwasher (1) as in claim 3, wherein the at least one auxiliary nozzle (7) is positioned to spread water towards the intermediary element (9).

5. The dishwasher (1) as in any one of the claims 2 to 4, wherein the adaptor (11) further comprises at least one auxiliary nozzle (7).

6. The dishwasher (1) as in any one of the claims 2 to 4, wherein the at least one auxiliary nozzle (7) comprises a rotary nozzle.

7. The dishwasher (1) as in any one of the claims 2 to 4, wherein the at least one auxiliary nozzle (7) further comprises at least one shower cap.

8. The dishwasher (1) as in claim 1, wherein the distributor has only two ends.

* * * * *